United States Patent [19]

Korsch et al.

[11] 3,964,278

[45] June 22, 1976

[54] APPARATUS FOR TREATING TEXTILE MATERIALS

[75] Inventors: Alfred Korsch, Krefeld; Friedrich Schneiders, Monchengladbach, both of Germany

[73] Assignee: D. Dupuis & Co., Monchengladbach, Germany

[22] Filed: Sept. 30, 1974

[21] Appl. No.: 510,389

[30] Foreign Application Priority Data

Mar. 16, 1974 Germany ..... 2412731
July 14, 1973 Germany ..... 2335993

[52] U.S. Cl. ..... 68/5 E; 34/104; 68/8; 68/150; 68/210; 277/34.6

[51] Int. Cl.[2] ..... D06B 5/18

[58] Field of Search ..... 68/5 E, 8, 7, 15, 150, 68/189, 198, 199, 210; 34/104, 110, 115, 122; 277/26, 34, 34.3, 34.6, 72 R

[56] References Cited

UNITED STATES PATENTS

| | | | |
|---|---|---|---|
| 1,887,626 | 11/1932 | Elssner et al. | 68/198 X |
| 2,350,191 | 5/1944 | Raymond | 68/189 |
| 2,831,541 | 4/1958 | Conover | 277/34.6 X |
| 3,604,223 | 9/1971 | Packshies et al. | 68/150 |

FOREIGN PATENTS OR APPLICATIONS

| | | | |
|---|---|---|---|
| 619,365 | 3/1949 | United Kingdom | 68/198 |

*Primary Examiner*—Peter Feldman
*Assistant Examiner*—Philip R. Coe
*Attorney, Agent, or Firm*—Herbert E. Kidder

[57] ABSTRACT

Apparatus comprising an inner cylinder and an outer cylinder which are telescoped with respect to one another to define between them an annular treatment chamber in which materials, such as textiles, are treated with a fluid medium. The ends of the annular chamber are closed by radial flanges on one of the cylinders, and clearances are sealed by pressurized seals. Material to be treated is wound onto the inner cylinder, and fluid medium is circulated through the chamber while one cylinder is rotated and the other remains stationary. At the conclusion of treatment, one of the cylinders is moved axially with respect to the other so as to expose the inner cylinder for unloading and reloading. Novel T-shaped seals of rubberlike material are mounted within annular grooves in the cylinder flanges, with the head of the T forming a diaphragm and the leg of the T projecting toward the other cylinder. Fluid pressure is applied to the diaphragm, causing the leg of the T to move toward the other cylinder in sealing engagement therewith. In some embodiments of the invention, one or both of the cylinders may have double walls, and the outer wall may be perforated to support the material, or both walls may be imperforate to form chambers through which heating or cooling medium may be circulated.

6 Claims, 17 Drawing Figures

APPARATUS FOR TREATING TEXTILE MATERIALS

This invention relates to an apparatus for treatment with a fluid medium, for example steaming, fixing, dyeing, boiling, bleaching, washing, rinsing or finishing, of material, particularly textiles.

It is known to wind webs of material for such treatment onto so-called "coiling stars" in spirals. For this purpose the coiling stars have hooks or the like provided on the spokes of said stars for securing the web of material, the individual hooks of each series being disposed with spacing from each other and pointing radially outwardly with their hook tips, as seen from the axis of the coiling star. This results in the possibility of suspending a considerable quantity of web of material on a narrowly limited space, i.e. in such a manner that in spite of the winding in spirals, no points of contact between the faces of the fabric arise.

Such devices are exceedingly complicated in their structure and therefore very expensive in manufacture. Furthermore, they are frequently susceptible to repairs and their maintenance is time-wasting.

An object of the present invention is thus to provide a treatment apparatus which is simple in its structure and its manipulation, whereby in particular the difficult pinning-on process can be done away with.

For achieving this object the invention starts from the consideration that it is not absolutely necessary for a proper performance of the process of treatment that no points of contact tetween the faces of the fabric arise but that it is much more important that the pressure between the individual layers of the coiled material should not be too high. The invention accordingly provides an apparatus for treatment with a fluid medium of material, comprising at least two coaxial telescoping cylinders defining when aligned an annular treatment chamber for the material, the ends of the chamber being sealable by annular sealing rings, and lines being provided for supply of fluid medium to the chamber. An inner one of the cylinders serves advantageously as the winding member for the webs of textile material.

It is apparent that due to the treatment chamber being limited to the annular chamber between the two cylinders, a relatively large diameter or cylinder circumference is available for winding the web of material onto the inner cylinder, so that a great length of the web of material can be accommodated with relatively few layers. This, in turn, results in that the webs of material do not rest too firmly upon each other in the individual layers and the treatment process can, as a consequence, be carried out satisfactorily.

Conveniently, the inner cylinder may be stationary and the outer cylinder movable. This arrangement is of particular advantage if two inner cylinders are arranged in series and one outer cylinder used for both inner cylinders are provided. In this case, while one inner cylinder undergoes the treatment process, the adjacent inner cylinder can be supplied again or the already treated material removed therefrom.

The sealing rings for closing the treatment chamber are preferably disposed in end flanges of at least one cylinder. The arrangement is preferably effected on the inner cylinder since the sealing rings can then be disposed externally on the circumference of the flanges. Here it is also advantageous that the gasket rings are movable in an annular groove which can be connected to a pressurising line. After the telescoping of the inner and outer cylinders has been completed, the sealing takes place by the pressurising action in the annular groove. A gaseous medium is here preferably used as a pressure medium. This is preferably as compared with liquids, in particular oil, in that no smudges can result in case of leaks.

The flanges of the inner cylinder preferably extend approximately over the entire cross-sectional area of the treatment chamber. Since the webs of material are preferably arranged on the inner cylinder, such a construction has the advantage that the wound material cannot abut against the outer cylinder when the cylinders are pulled apart.

Furthermore a plurality of coaxial telescoping inner cylinders may be provided defining when aligned annular treatment chambers sealable by annular sealing rings. It becomes possible in this way to form several treatment chambers so that the capacity of the apparatus can be doubled or almost multiplied.

The inner cylinders may be constructed with double walls, the outer wall being perforated. A better circumcirculation of the treating medium on the web of material is ensured by this arrangement. This purpose may further be served by spacer rings which divide the double-wall chamber into annular chambers.

The chambers should have controllable lines for supply of treating medium so that a precise control will also be possible in this respect.

It is furthermore advantageous that the double walls of the inner cylinder can be moved axially with respect to each other and both walls can be closed by annular sealing rings. One or more further outer walls constructed as perforated sheets may be provided.

It is furthermore useful for certain purposes to construct the outer walls so as to be rotatable. This is useful, for example, if the material to be treated is to be soaked in a bath so that for example half the treatment chamber is filled with treating liquid.

For certain types of treatment it may also be useful to construct the cylinders so as to be heatable.

In order to attain a better seal of the treatment chambers, the section of the sealing ring is preferably T-shaped; the head piece of the T-section is arranged in the manner of a diaphragm in a sealing annulus provided in the locking member or in the housing of the treatment chamber; the faces of the head piece engage the faces of the sealing annulus with initial stress and the arm of the T-section being the sealing lip is movably guided in an open annular groove which is in connection with the sealing annulus and points to the sealing surface, and the sealing annulus can be acted upon by a pressure medium towards the head face of the T-section.

The annulus is preferably rhombic in cross-section. The head piece arched towards the corresponding side by the initial stress and by the impact of excess pressure or underpressure can thereby engage the oblique walls with result that an improved sealing action between the pressure chamber and processing chamber is achieved.

The sealing action is further improved when the sides of the annulus are corrugated, whereby a labyrinth sealing action is achieved.

The invention will now be more particularly described by way of example with reference to the accompanying drawings, in which.

Figure 1:
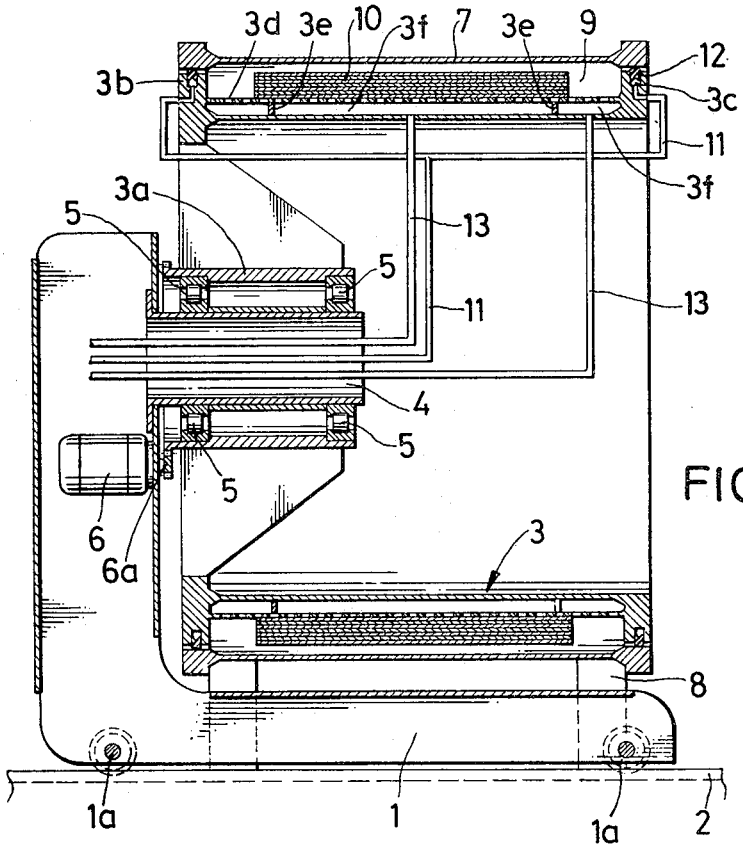
FIG. 1 is a diagrammatic axial sectional view of a treatment apparatus with one outer and one inner cylinder.
Figure 2:
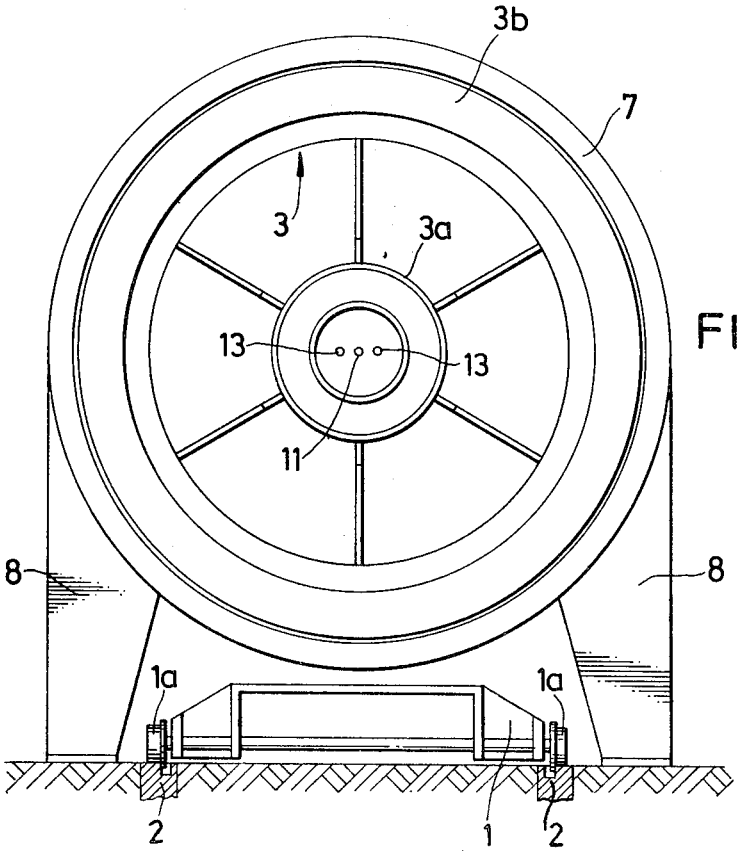
FIG. 2 is an end view of the apparatus of FIG. 1.

As shown in FIGS. 1 and 2, a chassis 1, which runs with wheels 1*a* on rails 2, supports an inner cylinder 3 by means of a cylindrical plug 4 fitted on the chassis 1 rotatably engaging with a central mounting support 3*a* of the inner cylinder 3 via roller bearings 5. On the chassis 1 is also fitted a motor 6 which by means of a driving pinion 6*a* drives the inner cylinder 3. An outer cylinder 7 coaxially disposed around the inner cylinder 3 is stationarily mounted on a support 8 so that the inner cylinder 3 can be moved into and out of said outer cylinder by means of the chassis.

An annular chamber 9 is formed between the two cylinders 3 and 7 and serves as a treatment chamber for a web of material 10.

Annular flanges 3*b* of the inner cylinder 3 extend approximately over the cross-sectional area of the annular chamber 9 and include external annular grooves 3*c* which are connected to a pressurising line 11. When the grooves 3*c* are acted upon by pressure via the pressurising line 11, sealing rings 12 inserted in the grooves 3*c* are thereby pressed onto the outer cylinder 7 and thus seal off the annular chamber 9.

The inner cylinder 3 is furthermore constructed with double walls, an outer wall 3*d* being a perforated sheet onto which the web of material 10 is wound. The chamber formed by the double walls is furthermore divided by spacer rings 3*e* into separate chambers 3*f* which, for their part, have separately controllable lines 13 for the supply of treating medium and the removal thereof by suction.

Figure 3:
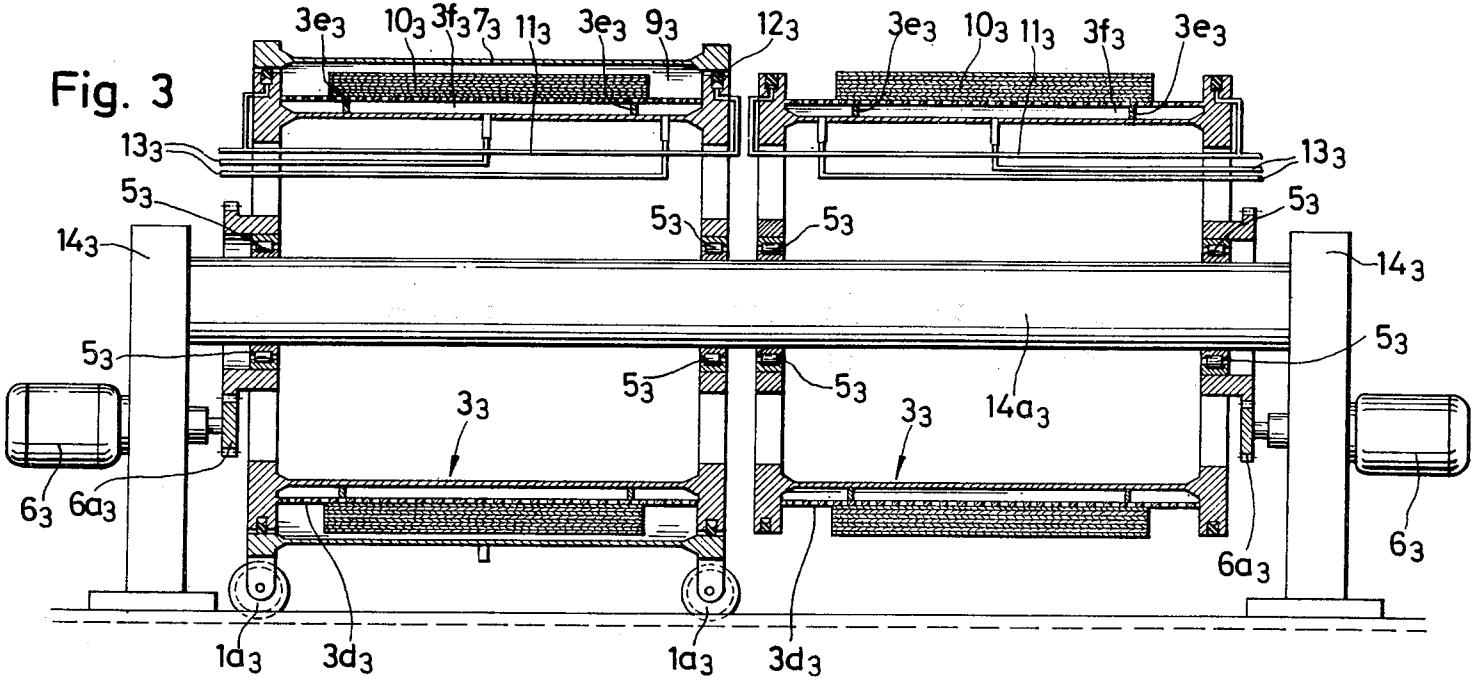
FIG. 3 is a diagrammatic axial sectional view of an apparatus comprising two inner cylinders and one outer cylinder.

FIG. 3 shows an embodiment in which two inner cylinders $3_3$ are arranged in series and rotatably mounted on a shaft $14a_3$ between supports $14_3$ via roller bearings $5_3$. The inner cylinders $3_3$ are driven by motors $6_3$ via driving pinions $6a_3$. An outer cylinder $7_3$ is movably mounted on on wheels $1a_3$ which run on rails $2_3$ so that it can selectively be aligned over either of the inner cylinder $3_3$.

The embodiment shown in FIG. 3 otherwise corresponds in further details to FIGS. 1 and 2, and corresponding parts have been provided with corresponding reference numerals.

FIGS. 4 to 13 are detail sections of various alternative configurations of the treatment chambers. Reference numerals corresponding to FIGS. 1 to 3 have again been employed.

Figure 4:
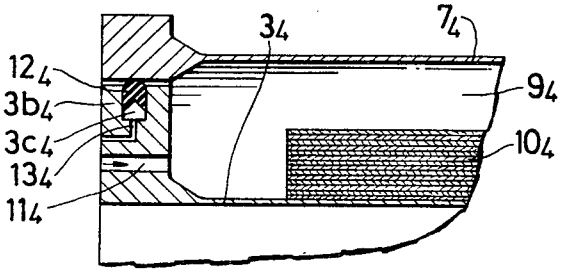
FIGS. 4 to 13 show in diagrammatic sectional views various alternative arrangements of inner and outer cylinders.

FIG. 4 shows an inner cylinder $3_4$ and outer cylinder $7_4$ in the simplest form of construction. The inner cylinder $3_4$ serves for winding the web of material $10_4$. A line $11_4$ for the treating medium is located in a flange $3b_4$ of the inner cylinder $3_4$.

Figure 5:
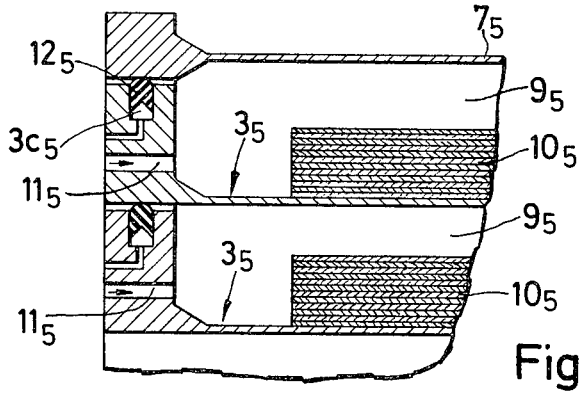

In FIG. 5 two telescoping inner cylinder $3_5$ of similar form are provided, one within the other. The two annular chambers $9_5$ can be sealed off by gasket rings $12_5$.

Figure 6:
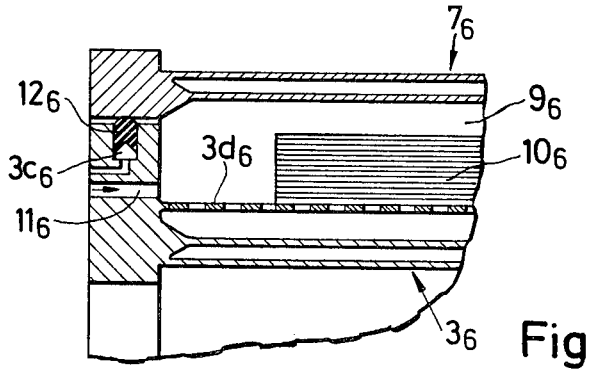

FIG. 6 shows an embodiment in which cylinders $3_6$ and $7_6$ are each constructed with double shells defining annular spaces for a heating or cooling medium. Further, a perforated sheet $3d_6$ is provided on which — as in FIGS. 1 to 3 — the web of material $10_6$ is wound.

Figure 7:
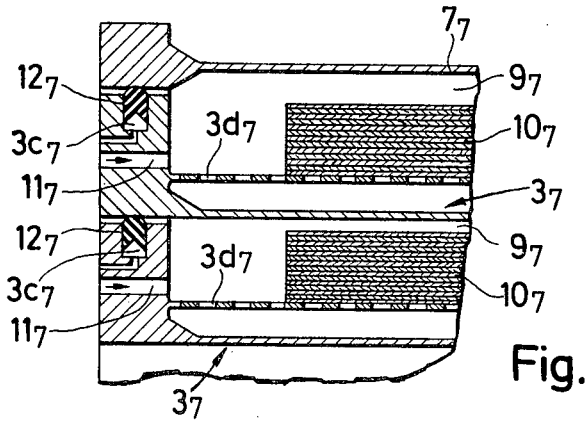

FIG. 7 shows an embodiment corresponding to FIG. 5 but further including perforated sheets $3d_7$ for receiving its webs of material $10_7$.

Figure 8:
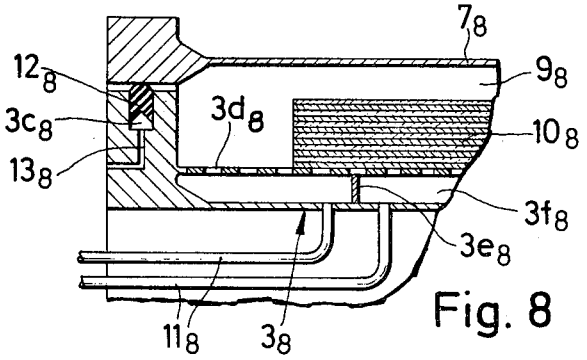

FIG. 8 illustrates the embodiment also shown in FIGS. 1 to 3, with perforated sheets $3d_8$ and spacer rings defining chambers $3f_8$ communicating with lines $11_8$.

Figure 9:
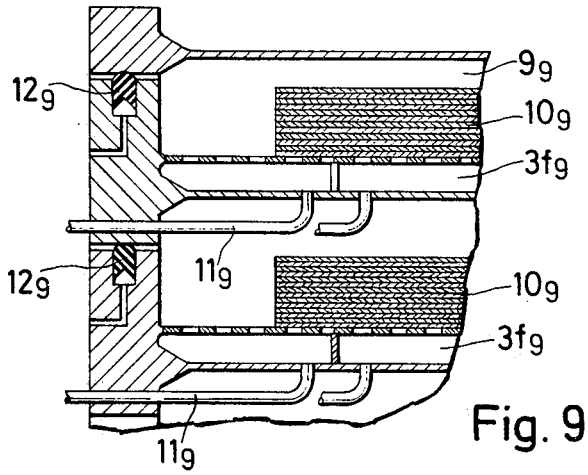

FIG. 9 is an embodiment similar to FIG. 8 of a twin cylinder arrangement corresponding to FIGS. 5 and 7.

Figure 10:
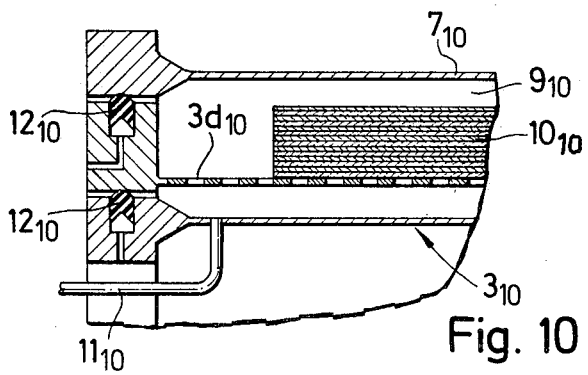

FIG. 10 shows an embodiment in which the perforated sheet $3d_{10}$ and the inner cylinder $3_{10}$ are constructed so as to be individually movable and sealable by seals $12_{10}$.

Figure 11:
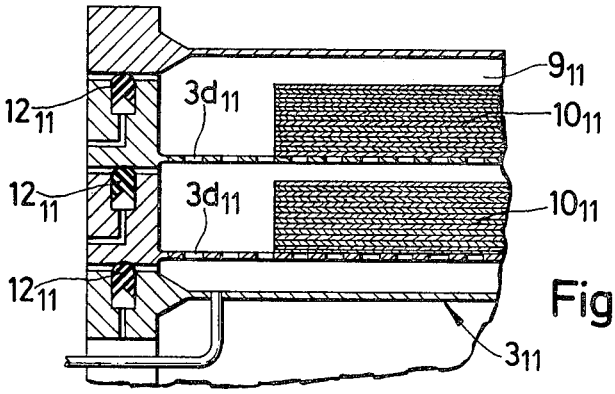

In FIG. 11 an embodiment is shown in which the inner cylinders $3_{11}$ have two perforated sheets $3d_{11}$, both of which are reciprocally sealable by means of sealing rings $12_{11}$ and can be removed separately. With this arrangement and that according to FIG. 10 it is possible to arrange that both the inner cylinder as well as the outer cylinder are stationary so that merely the perforated sheets are removable.

Figure 12:
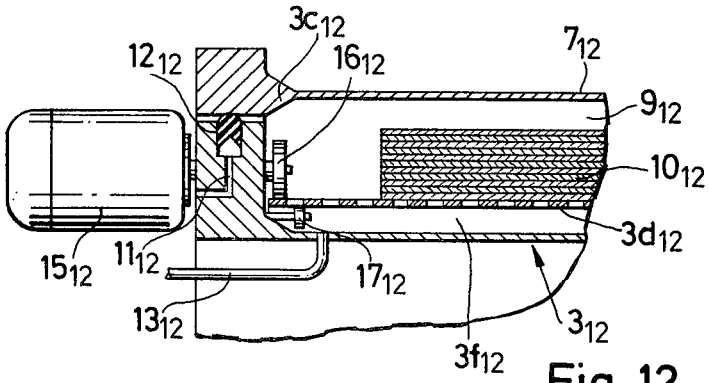

In the embodiment shown in FIG. 12, the inner cylinder $3_{12}$ is likewise equipped with a perforated sheet $3d_{12}$, said perforated sheet $3d_{12}$ being, however, separately movable by means of a motor $15_{12}$. For this purpose a driving pinion $16_{12}$ acts directly on the perforated sheet $3d_{12}$, a support wheel $17_{12}$ being additionally provided for reinforcement.

Figure 13:
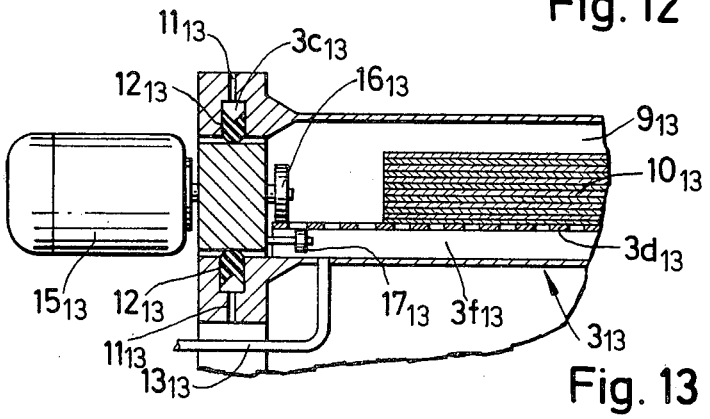

The embodiment shown in FIG. 13 corresponds to that of FIG. 12 in respect of the drive of the perforated sheet $3d_{13}$; differing therefrom, however, the perforated sheet $3d_{13}$ is in this case arranged so as to be separately removable, as also shown in FIG. 10.

In FIGS. 14 to 17 a different embodiment of a sealing ring 12 is shown in various examples of mounting. This gasket ring 12 is particularly suitable for being mounted in the inner cylinder of cylinders 3 of the apparatus and considerably improves the sealing effect.

Figure 15:
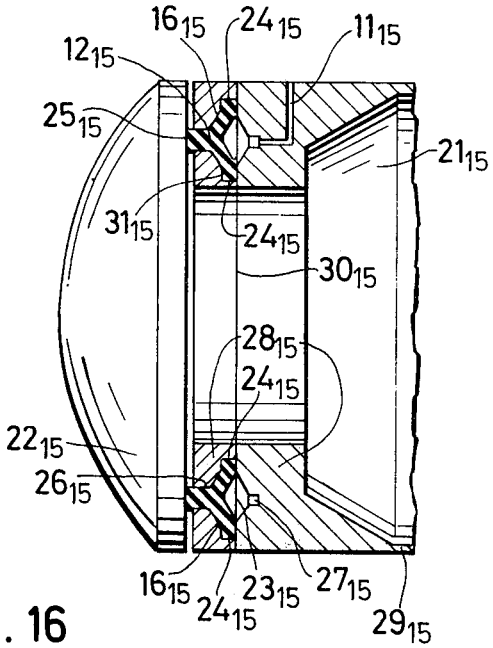
FIG. 15 shows a treatment apparatus, including the sealing ring of FIG. 14 on an end face.
Figure 16:
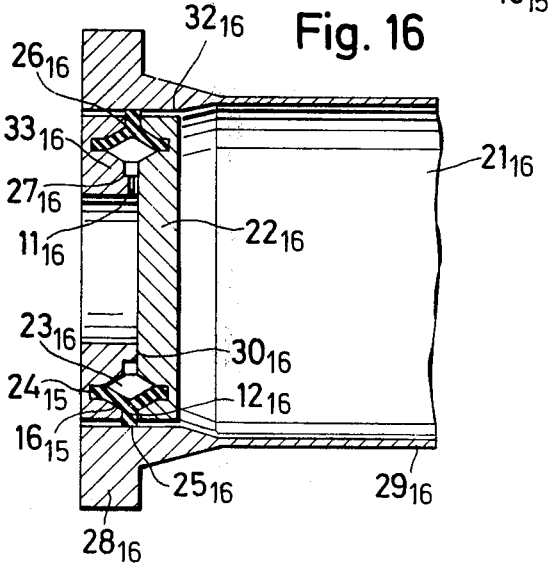
FIG. 16 shows a treatment apparatus with the sealing ring of FIG. 14 on a cylinder surface.
Figure 17:
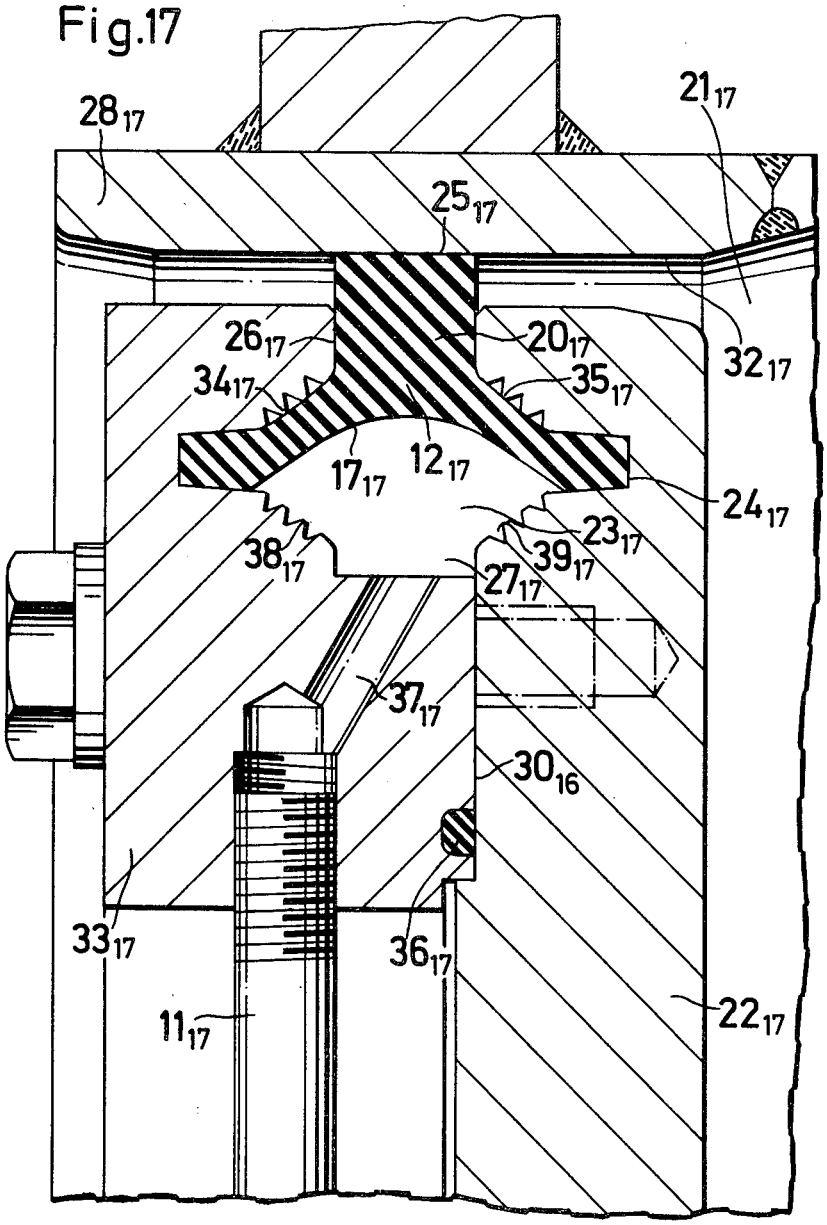
FIG. 17 shows a detailed view of the sealing ring in its seating.

The examples of mounting in FIGS. 15 to 17 show in a general way cylindrical treatment chambers which can be closed on their front faces by locking members in the form of covers. In place of the locking member shown in particular in FIG. 16, a movable inner cylinder, and in place of the housing designated in the following as "drum", an outer cylinder 7 are just as well viable, whereby the treatment chamber is reduced to an annular chamber.

Figure 14:
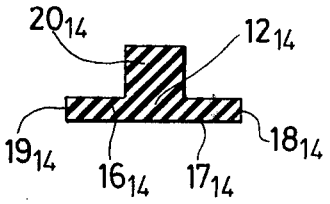
FIG. 14 shows a cross-section of a preferred form of sealing ring.

FIG. 14 shows a cross-section of a sealing ring $12_{14}$ in an unloaded state. The sealing ring is of a T-shaped configuration and consists of a head portion $16_{14}$ with a head face $17_{14}$ and side faces $18_{14}$ and $19_{14}$, and a sealing lip $20_{14}$.

FIG. 15 shows in axial section an embodiment of a part of an apparatus for the treatment of textile materials, namely the end of a treatment chamber $21_{15}$ with a locking member $22_{15}$ constructed as an outwardly arched cover. The gasket ring $12_{15}$ is here inserted in an annular space $23_{15}$ of rhombic cross-section, the side faces $18_{14}$ of the head piece $16_{15}$ of the gasket ring $12_{15}$ being pressed onto side faces $24_{15}$ of the annular space $23_{15}$. For this purpose the spacing of the side faces $24_{15}$ is so chosen that the head piece $16_{15}$ will be buckled and therefore, after being acted upon by excess pressure from supply lines $11_{15}$ will be so arched towards the sealing surface $25_{15}$ of the member $22_{15}$ and by underpressure in the opposite direction that it will engage the corresponding walls of the annular space $23_{15}$. In the present case the head piece $16_{15}$ is arched towards the sealing surface $25_{15}$ and seals off the treatment chamber with the sealing lip $20_{14}$ moving in an annular groove $26_{15}$ which is open towards the annular space $23_{15}$ and towards the sealing surface $23_{15}$, and engaging the locking member $22_{15}$. The pressure with which the sealing lip $20_{15}$ is pressed against the sealing surface $25_{15}$ of the locking member $22_{15}$ can be controlled by the pressure acting on the head face $17_{15}$. This pressure is produced pneumatically via the pressurising line $11_{15}$ and a further groove $27_{15}$.

So that the sealing ring $12_{15}$ can be inserted in the annular space $23_{15}$, a housing flange $28_{15}$ is divided at the end of the drum $29_{15}$ in the radial direction, the line $30_{15}$ of division passing approximately through the centre of the annular space $23_{15}$. After dismantling the outer portion $31_{15}$ of the housing flange $28_{15}$, both parts of the annulus space lie open and free of undercuts so that the sealing ring $12_{15}$ can easily be inserted.

FIG. 16 shows another, further alternative embodiment of the apparatus. Here the cylindrical inner wall $32_{16}$ of the housing flange $28_{16}$ serves as sealing surface $25_{16}$ so that the likewise cylindrical locking member $22_{16}$ is now seated inside the drum $29_{16}$ and thus fills the space not utilised in the embodiment according to FIG. 15. In addition, the locking member becomes thereby much smaller in its dimensions. The gasket ring $12_{16}$ is here not inserted in the drum $29_{16}$ but in the locking member $22_{16}$. Also its form of construction is changed. Its sealing lip $20_{16}$ not protrudes outwardly from the annular groove $26_{16}$ whilst the head piece $26_{16}$ under compression in the likewise rhombic annular space $23_{16}$ is arched outwardly. For inserting and exchanging the gasket ring, the left-hand ring-shaped portion of the locking member $22_{16}$ may be dismantled, the separating line $30_{16}$ being again so placed that the annular space $23_{16}$ is divided approximately in the centre and therefore after the disassembling lies open and free of undercuts.

FIG. 17 shows in a detailed drawing the constructive design of the cutaway portion with the gasket of the apparatus according to the embodiment shown in FIG. 16. The annular space $23_{17}$ is formed by wedge-shaped recesses in the locking member $22_{17}$ and in its screwed-on ring-shaped portion $33_{17}$. In the annular space $23_{17}$ is inserted the sealing ring $12_{17}$ with the sealing lip $20_{17}$ guided in the annular groove $26_{17}$ said gasket ring being arched outwardly towards the cylindrical sealing surface $25_{17}$. This ring engages the walls $34_{17}$ and $35_{17}$ which, like the sides opposite to them, are provided with grooves for a further increase of the sealing effect. The separating line $30_{16}$ is sealed off by an O-ring $36_{17}$ for preventing loss of pressure medium.

The pressure medium arrives via a pressurising line $11_{17}$ and an oblique passage $37_{17}$ in the sealing annulus $33_{17}$. While the locking member $22_{17}$ is pushed into the drum $29_{17}$ a vacuum is produced in the sealing annulus $23_{17}$ so that the gasket ring $12_{17}$ engages the walls $38_{17}$ and $39_{17}$ lying inside and the sealing lip $20_{17}$ does not protrude from the annular groove $26_{17}$, whereby it is well protected against damage. When the locking member $22_{17}$ is in its final position, pressure is exerted on the head face $17_{17}$ with the result that it jumps into the position shown in FIG. 17 and presses the sealing lip $20_{17}$ against the sealing surface $25_{17}$.

With this embodiment of a sealing ring between the drum and the locking member or an analogous application thereof between the inner cylinder and outer cylinder, reliable sealing of the treatment chamber against loss of pressure medium is ensured.

What we claim is:

1. Apparatus for the treatment of textile fibers with a fluid medium, comprising coaxial inner and outer cylinders;

support means on said inner cylinder, upon which said textile fiber is wound; one of said cylinders being rotatable, and the other being non-rotatable; means for driving said rotatable cylinder; one of said cylinders being movable axially with respect to the other between a first position in which the inner cylinder is telescoped within the outer cylinder, and a second position wherein the inner cylinder is entirely removed from the outer cylinder; said inner cylinder having axially spaced radial flanges defining end walls that extend outwardly to the inner surface of the outer cylinder; said inner cylinder and flanges cooperating with said outer cylinder to define an enclosed annular treatment chamber for said textile fiber; and means for circulating treatment fluid through said annular chamber as the rotatable cylinder turns relative to said non-rotatable cylinder.

2. The apparatus of claim 1, wherein said radial flanges have annular seals on their peripheral edges which contact the inner surface of said outer cylinder to seal the running clearances between the relatively rotating flanges and outer cylinder.

3. The apparatus of claim 2, wherein said seals are contained within annular grooves in said flanges; and means for introducing pressure fluid into said annular grooves below said seals whereby the seals are expanded outwardly by fluid pressure to contact the inner surface of the outer cylinder.

4. The apparatus of claim 1, wherein said inner cylinder is rotatable and said outer cylinder in non-rotatable.

5. The apparatus of claim 4, wherein said outer cylinder is stationary, and said inner cylinder is movable axially with respect to the outer cylinder between said first and second positions.

6. The apparatus of claim 1, wherein said support means on said inner cylinder comprises a perforated cylindrical support spaced radially outward from the inner cylinder to provide an open space below said fibers; said fluid circulating means introducing the treatment fluid into said open space, where it passes outwardly through the perforation in said cylindrical support and through the fiber wound thereon.

* * * * *